US005906211A

United States Patent [19]

Mason

[11] Patent Number: 5,906,211

[45] Date of Patent: May 25, 1999

[54] ASH TRAY

[76] Inventor: Eugene E. Mason, 870 Avenue "B" #204, Boulder City, Nev. 89005

[21] Appl. No.: 08/613,687

[22] Filed: Mar. 11, 1996

[51] Int. Cl.[6] ..... A24F 13/18

[52] U.S. Cl. ..... 131/256; 131/235 R

[58] Field of Search ..... 131/256, 235 R

[56] References Cited

U.S. PATENT DOCUMENTS

| | | | |
|---|---|---|---|
| 2,120,027 | 6/1938 | Johnson | 131/256 |
| 2,506,666 | 5/1950 | Graham | 131/256 |
| 2,715,961 | 8/1955 | Field | 131/256 |
| 2,796,067 | 6/1957 | McCutcheon et al. | 131/256 |
| 3,386,452 | 6/1968 | Davis | 131/256 |
| 4,055,193 | 10/1977 | Lehman | 131/256 |
| 4,516,587 | 5/1985 | Eastridge et al. | 131/256 |
| 4,886,076 | 12/1989 | Gilbert et al. | 131/256 |

FOREIGN PATENT DOCUMENTS

| | | | |
|---|---|---|---|
| 3124346 | 1/1983 | Germany | 131/256 |

*Primary Examiner*—John G. Weiss
*Assistant Examiner*—William J. Deane, Jr.

[57] ABSTRACT

A cursory inspection of the device reveals a small "Funnel" but because the funnel (or device) is plugged at the base (or bottom) the name "Funny Funnel" was developed. Unlike a true funnel, the back is flat and higher than the rounded front. The highly visible area on the inside of back will be referred to as the "area of promotion," which may be used for advertising, logos, etc. Vehicle use requires a Velcro® "button" for support while home or industrial use requires a supportive base. In both instances the "funnel" can be easily removed for cleaning, etc. A burning cigarette is easily deposited because of the large opening at the top. The cigarette will extinguish itself in seconds and can be relit. The "funnel" shape of the device, the use of the Velcro® button and the "area of promotion" are new a new concept for cigarette extinguishers.

1 Claim, 1 Drawing Sheet

ASH TRAY

BACKGROUND OF THE INVENTION

1.Field of the Invention

This invention relates to a device for extinguishing cigarettes, which is very easy to use, is simple in design and materials (and can therefore be mass-produced at low cost), and, most importantly, exhibits one or more exterior areas that can be used for advertisements, logos, and messages, thus making the device very attractive as a give-away or as a very inexpensive item, to be used for promotional activities.

2. Background

Numerous devastating fires, often in remote forest and brush areas (but also in houses, apartments, and mobile homes), are caused every year by the careless disposal of still-glowing cigarette butts, especially by glowing butts thrown out of automobile windows by drivers or passengers. Besides causing great economic damage to individuals, the environment, and the U.S. economy in general (thus affecting every taxpayer in the U.S.A. through Government-financed fire-fighting, restoration and reclamation), such carelessly started fires have also caused loss of lives, including the lives of firefighters tasked to extinguish or confine the fires. Such man-made catastrophes occur especially frequently in the dry western part of the U.S.A.

Most drivers and passengers of automobiles extinguish their cigarette butts by crushing them in the (sometimes very small) ashtrays installed for this purpose in automobiles, and most responsible smokers in living quarters use ashtrays, too. A small number of smokers, however, fail to use the designated ashtrays because of inattention or ignorance.

3. Description of the Prior Art

Several cigarette-extinguishing devices that go beyond simple ashtrays have been described in the patent literature of the past 50 years or so. Many of these devices are functional, as described in the patents, but none of them has found widespread use in the U.S.A. The results of our limited research suggest that the main reasons are the lack of motivation on the part of the potential users to bother with the sometimes cumbersome devices, combined with the slight inconvenience of using them, and the relatively high manufacturing costs and, therefore, high retail costs of the devices (notwithstanding the claims made in several of the above-mentioned patents that the devices are "simple and easy to manufacture" or "inexpensive to manufacture"). In recent years, the motivation of smokers to use safe, "positive" cigarette-extinguishing methods has increased because of increased public emphasis on, and awareness of, environmental issues; this is supported and enhanced by slogans and cartoon figures like Smokey, the Bear. However, cigarette-extinguishing devices are still virtually unknown to most of the potential users in the USA, and such devices are not generally available, if at all. Therefore, a device for extinguishing cigarettes is needed, which can be used in a variety of scenarios, is made of fire-resistant materials, is easy and safe to use, and, above all, is inexpensive and therefore readily accepted by the potential users. The acceptance by the potential users depends, in addition to genuine environmental and safety concerns and ease of use, mainly on two factors:

- the device must be available at no or minimal cost, and/or
- the design and appearance of device must elicit a positive response from the users by appealing to some of the users' preferences, e.g., by displaying a certain design or logo (NRA, NBA, Smokey, Happy Face, etc.).

To provide anything free of charge, or very cheap (e.g., below cost), in a free economy, an individual or a company must be willing to bear the manufacturing and distributing costs, or provide subsidies. In turn, there must be an incentive, a reason, for the sponsors to bear all or part of the cost. One such incentive is to provide the sponsor with the possibility to use the device for advertising his company or company products to the targeted users (and others being in the proximity of the device and thus also being exposed to such advertisements).

Sponsors and distributors who might find sponsoring such a device attractive include

- national and international companies advertising either their logos or some specific products, such as oil companies, car makers, food, beverage, and cigarette manufacturers and distributors, theme parks (e.g., Disneyland), and the like;
- individual states (e.g., Florida), townships (e.g., Las Vegas), individual resorts and hotels or hotel chains (e.g., Caesar's Palace in Las Vegas), and the like;
- popular sports teams and sports events (football, baseball, basketball, golf, etc.) clubs and associations (e.g., Lions, Shriners, VFW, NRA, etc.), convention and exposition organizers (e.g., COMDEX, Expo, etc.), and the like;
- Governments entities (e.g., EPA, National Park Service, U.S. Forest Service, etc.).

None of the inventors who have been issued patents for cigarette extinguishers (the "prior art") has recognized the above-explained promotional features and requirements, especially the importance for adding an area of advertising space, features that are paramount to the successful introduction of such devices to the public. What is therefore deemed to be new and above the prior art is outlined below.

SUMMARY OF THE INVENTION

An efficient, safe, versatile, and inexpensive cigarette extinguishing device is disclosed, which exhibits one or more exterior areas that can be used for carrying advertisements, logos, pictures, messages, and the like, thus making the device attractive as a give-away or very inexpensive item to be used for promotional activities The device, in its simplest form, is best described as a semi-funnel, i.e., a funnel cut lengthwise in half, except that the narrow lower part is of a cylindrical shape with an inner diameter large enough to accommodate a cigarette butt. The cylindrical lower part of the semi-funnel is closed at its bottom, either permanently (most likely with the same material that is used for the construction of the semi-funnel), or by some suitable material that can easily be removed and replaced again for cleaning, such as a crumpled piece of aluminum foil.

The semi-funnel can be attached to surfaces using a conventional fastening device, which can be the hook-and-loop type, a magnetic button, adhesive tape, sliding device, or the like, with the corresponding holding device attached to the surface on which the semi-funnel is to be mounted.The kind of fastening device will depend on the intended location of the device and on economic considerations. For conveniently attaching the semi-funnel to the clothing or equipment carried by a person who wants to take the device with him, the flat side of the device can be provided with a hole that extends upwards into a slot, so that it can either be attached directly to a button on the person's clothing or equipment, or a "double-button" can be used, the back part of which can be inserted into an existing button hole on the person's clothing while the front part is inserted into the hole in the back of the semi-funnel and secured by pulling the device downward. This alternative is for the convenience of hikers and other outdoor persons who like to smoke. It allows them to safely, fast, and easily extinguish cigarette butts, thus demonstrating their compliance with the laws and their concern for nature.

The novel feature of the semi-funnel is, in addition to the use of a double button as a fastening device, the use of its surface for pictures, advertisements, logos, and other messages. The advertising area is created first by substantially lowering the front lip of the device so as to expose the flat back area, as shown in the accompanying drawings. This area can easily and cost-effectively be further extended by either increasing the height and the width of the flat area, or by surrounding the semi-funnel by a larger piece of material, as illustrated by the accompanying drawings. Obviously, for different areas or segments of the device and its extended promotional area, different colors can be used, including reflective paints and paints that glow in the dark, to achieve certain desired special effects.

As explained above, the incentive for potential sponsors is the use of this area for promotion. As a result, the device will be affordable and desirable for the potential users, thus making this novel aspect of the device the basis for the success. The engineering knowledge to cheaply mass-produce such devices is available.

The intended application of this device is to serve as a receptacle for glowing cigarette butts in automobiles (e.g., mounted on dashboards), businesses, apartments, and homes (e.g., attached to nightstands and other likely places), and simultaneously to promote safety and inspire its use by all safety-conscious cigarette smokers. The glowing cigarette butt is extinguished within seconds in one simple step. By dropping the glowing cigarette or cigarette butt into the semi-funnel, the cigarette tip will funnel down to the bottom through the cylindrical part, which is designed to be slightly wider than the diameter of the cigarette. As a result of the confinement of the glowing cigarette tip at the bottom of the semi-funnel, any air is blocked from reaching the glowing tip, which, since it is starved of oxygen, will almost immediately extinguish without emitting additional smoke. The base of the semi-funnel, which may be closed by a piece of crumpled aluminum foil, also serves as a heat sink.

Because the extinguishing action is quick and thorough, the heat to which the semi-funnel material is exposed is very small, and the semi-funnel can be made from almost any material, including many virgin or recycled plastics. Obviously, other heat-resistant materials such as aluminum or other metals, ceramics, glass, and porcelain can also be used.

The final disposal of the extinguished cigarette butt is in an ashtray or a waste basket. Accordingly, it is an object of the present invention to provide a functional cigarette extinguishing device, made of fire-resistant material, which rapidly extinguishes a burning cigarette, and which can be used in a variety of situations.

Another object of this invention is to provide such a device that is easy and safe to use, is simple in design and material, and can therefore be mass-produced at low cost.

Another object of this invention is to provide such a device that exhibits one or more areas that can be used for advertisements, pictures, logos, and other messages, and that is still inexpensive enough to attract sponsors who, by being able to use the promotional areas for their advertising purposes, are willing to bear the cost of manufacturing and distributing these devices.

DESCRIPTION OF THE PREFERRED EMBODIMENT

Figure 1:
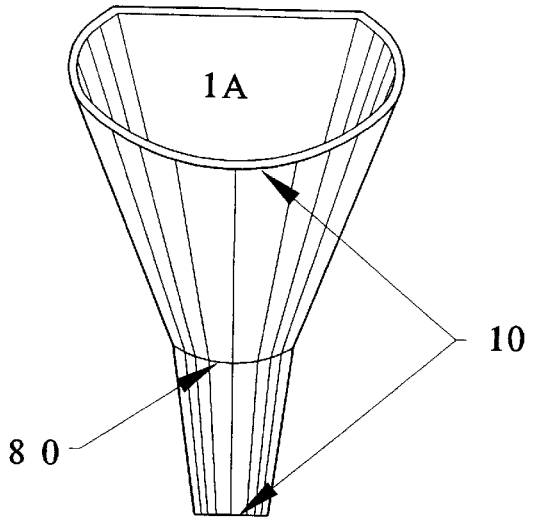
FIG. 1 is a perspective view of the most basic form of the cigarette extinguisher of the present invention.

Referring more particularly to the drawings, FIG. 1 shows the cigarette extinguisher of the present invention. The basic shape of the device is funnel-like, or rather semi-funnel-like, with the back part flattened, so that it can easily be attached to surfaces. The height 10 from the base to the front lip is 2 inches. Approximately 0.75 inches from the bottom of the semi-funnel-shaped device, the angle at which the funnel is constructed decreases somewhat to make the lower 0.75 inches almost cylindrical, as can be seen at line 80. The area 1A, the difference between the front and back heights of the device, is the primary area of promotion FIG. 2 further illustrates these points. The height of the flat part 20 of the device, from the base 70 to the upper rim, is 3 inches; the distance 60 from the front edge or lip to the flat backside is 1.25 inches, and the inside diameter of the base 70 at the very bottom is 5/16 inch, and it is circular. At the upper part of the flat part of the device, an area 1B is indicated, which marks the location at which the fastening device is attached. The fastening device could be any of the devices discussed in the Summary of the Invention.

Figure 2:
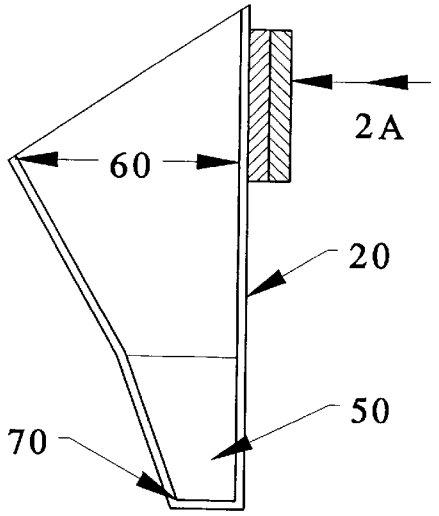
FIG. 2 is a sectional view of the cigarette extinguisher taken from the side of the device shown in FIG. 1
Figure 3:
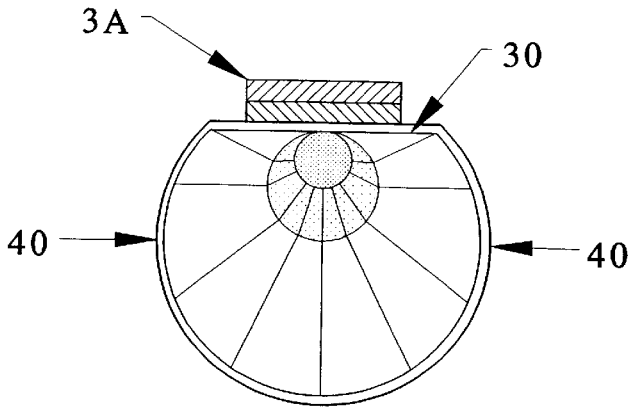
FIG. 3 is a view of the cigarette extinguisher when looking into the open end from above.

In FIG. 3, looking at the device from above, the distance 40, from upper edge to upper edge, is 2 inches, and the flat back 30 is 1.5 inches wide at the top. 3A corresponds to 1B in FIG. 2, the preferred area at which fasteners are attached.

All dimensions referred to above must be considered "inside". The reason for this is that because this device can be fabricated using a variety of materials (e.g., plastic, metal, ceramics, or combinations thereof), variations in structure may be required. Also, it is understood that the dimensions specified above could be altered, individually or combined, in order to adapt this device to specific uses and applications.

What I claim is:

1. A cigarette extinguisher comprising:

a semi-funnel shaped housing having an open first end and a smaller closed second end; said housing having a flat backing extending from said first end to said second end; a securing fastener connected to said flat backing; a shield-like device connected to said housing which can be used to place an advertisement thereon; both said housing and said shield-like device being made from non-combustible materials, and said housing containing crumbled pieces of non-combustible material; whereby after insertion of the glowing part of a cigarette into said housing the cigarette will be extinguished.

* * * * *